United States Patent [19]

Sherman

[11] 3,977,300

[45] Aug. 31, 1976

[54] ACTUATOR WITH FEEDBACK

[75] Inventor: Robert Sherman, West Hartford, Conn.

[73] Assignee: United Technologies Corporation, Hartford, Conn.

[22] Filed: Mar. 18, 1975

[21] Appl. No.: 559,459

[52] U.S. Cl. ..... 91/384; 91/382

[51] Int. Cl.[2] ..... F15B 9/10

[58] Field of Search ..... 91/382, 368, 384, 358 A; 415/26

[56] References Cited

UNITED STATES PATENTS

| | | | |
|---|---|---|---|
| 2,344,768 | 3/1944 | Dodson | 91/382 |
| 2,649,076 | 8/1953 | Dupre | 91/358 A |
| 3,129,643 | 4/1964 | Porter et al. | 91/382 |
| 3,653,409 | 4/1972 | Brannon | 91/368 |
| 3,917,430 | 11/1975 | Bloom | 415/26 |

FOREIGN PATENTS OR APPLICATIONS

| | | | |
|---|---|---|---|
| 976,877 | 11/1950 | France | 91/382 |

*Primary Examiner*—Paul E. Maslousky

*Attorney, Agent, or Firm*—John D. Del Ponti; Norman Friedland

[57] ABSTRACT

A generally conically shaped cam formed internally of the actuator piston and a follower connected to a rotary shaft serves to provide a position feedback signal within a minimum of space.

5 Claims, 2 Drawing Figures

ACTUATOR WITH FEEDBACK

BACKGROUND OF THE INVENTION

This invention relates to fluid actuators of the type that translates rectilinearly and particularly to its feedback mechanism.

This invention solved the problem of obtaining a small motion from an actuator piston whose stroke is relatively large while keeping the feedback mechanism internally resulting in a compact efficacious device. Although not limited thereto, this invention has particular application for turbine types of power plants where it is desirable to control the geometry of the engine and adapting the control mechanism to fuel control technology to include this mechanism within the fuel control package and to additionally minimize the number of external seals. Under typical conditions, it would be necessary to route the feedback linkage externally of the control and gain access at some location in the fuel control casing. By virtue of this invention, the seals that would otherwise be necessary at this interface are not needed.

SUMMARY OF THE INVENTION

The primary object of this invention is to provide improved feedback means to a rectilinear type of actuator.

A still further object is to provide internally of the actuator piston a cam surface for which a cam follower rides and converts the rectilinear motion to a rotary motion for providing a signal indicative of the position of the piston.

Other features and advantages will be apparent from the specification and claims and from the accompanying drawings which illustrate an embodiment of the invention.

DESCRIPTION OF THE PREFERRED EMBODIMENT

Figures 1, 2:
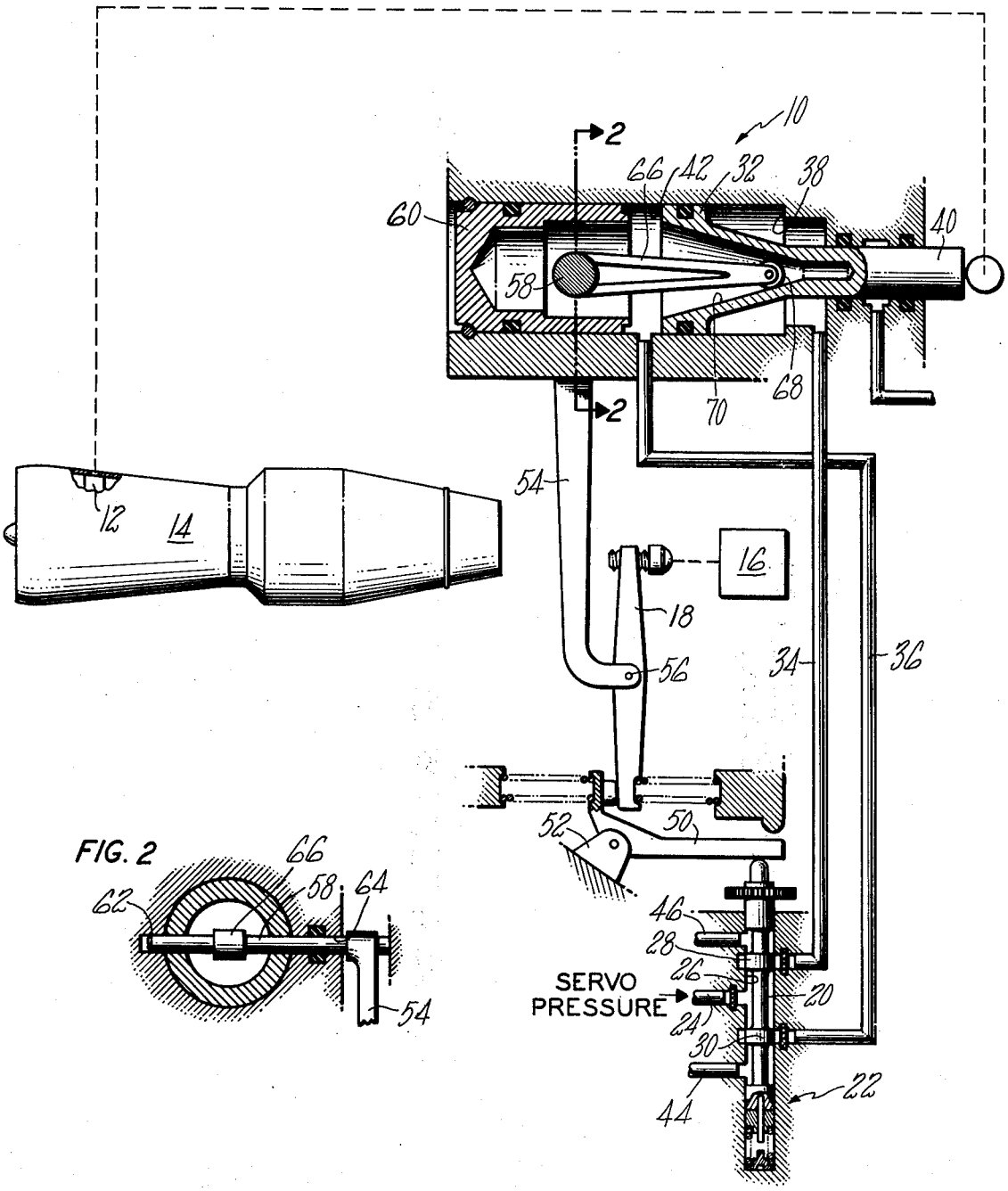
FIG. 1 is a view partly in section and partly in schematic illustrating the preferred embodiment of the invention.
FIG. 2 is a view, partly in section and partly in elevation taken along lines 2—2 of FIG. 1.

The invention can best be understood by referring to FIG. 1 showing the hydraulic actuator generally illustrated by reference numeral 10 which serves to position the variable stator vanes 12 of the gas turbine power plant 14 as a function of compressor speed and compressor inlet temperature which signal is manifested by a suitable fuel control generally illustrated by reference numeral 16. A suitable fuel control is the JFC-12, JFC-25, JFC-60 being exemplary, manufactured by the Hamilton Standard Division of United Aircraft Corporation or the control disclosed in U.S. Pat. No. 2,822,666 granted to S. G. Best on Feb. 11, 1958 and assigned to the same assignee. For the purpose of this invention, it is only necessary to understand that the speed and temperature signal, which are sensed and computed by the fuel control are utilized to control the actuator position and since the typical three-dimensional cams are indicative of the desired position such may be utilized to provide this signal.

Suffice it to say that the position of fulcrumed lever 18 is indicative of the desired actuator position as computed from the compressor speed and compressor inlet temperature of the power plant and serves to position the spool 20 of double acting pilot valve 22. Regulated servo pressure is admitted into pilot valve 22 via line 24 where it is directed into annular chamber 26, lands 28 and 30 now on the line-on-line position direct the pressurized fluid to either end of piston 32 of actuator 10 via lines 34 and 36. Hence, when spool 20 is in the upward position high pressure is directed to chamber 38 to act on the right hand side of piston 32 forcing it leftwardly. The connecting rod 40 positions stator vanes through well known linkages, gears and the like (only one being shown) in a given direction. In this mode of operation the fluid in chamber 42 acting on the left side of piston 32 is bled through line 36, past land 30 to drain line 44. Obviously, when the pilot valve is actuated downwardly, high pressure is ported to chamber 42 and chamber 38 is fed via line 34, past land 28, through drain line 46.

The command signal generated by fuel control 16 as described above serves to position the spring balanced bell crank 50 to rotate it about pivot 52 to position spool 20 upwardly or downwardly depending on the polarity of said signal. Feedback, to return spool 20 to its line-on-line position (as shown) is effectuated in accordance with this invention as follows.

Rod 54 to which fulcrumed lever 18 is pivotally connected at 56 is swung clockwise or counterclockwise depending on the direction of movement of piston 32. As noted in FIG. 2, rod 54 is suitably connected to shaft 58 journaled in the casing adjacent the stationary sleeve 60 by journal bearings 62 and 64. Hence rotation of shaft 58 serves to rotate rod 54, as viewed in this drawing in and out of the plane of the paper. Rotary motion to shaft 58 is imparted by follower arm 66 suitably supported to or made integral with shaft 58 by virtue of roller 68 riding on the generally conically shaped cam surface 70 formed internally of piston 32. Obviously, as one skilled in the art will appreciate the cam surface may be designed in any suitable profile to give a linear or nonlinear relationship relative to the movement of piston 32, as desired.

It is apparent from the foregoing that rectilinear movement of piston 32 is fed back via follower 66, shaft 58 and rod 54 to reposition bell crank 50 and hence spool 20 until the null, i.e., line-on-line position of lands 28 and 30 is effectuated. By virtue of this invention the feedback mechanism is internal of the piston resulting in a relatively compact, smaller in size, and hence lighter in weight than heretofore known fluid actuators. Additionally, seals heretofore necessary are eliminated.

It should be understood that the invention is not limited to the particular embodiments shown and described herein, but that various changes and modifications may be made without departing from the spirit or scope of this novel concept as defined by the following claims.

I claim:

1. An actuator including a housing having a cylinder, a piston disposed in said cylinder, a bore formed internally within said piston defining a cam surface, feedback means including a follower operatively connected to said piston slidably mounted relative to said cam surface for producing a feedback signal indicative of the displacement of said piston and hydraulic means acting on said piston to displace it rectilinearly, said hydraulic means including a servo pilot valve and linkage means operatively connected to said servo pilot valve, said linkage means providing an input signal for causing hydraulic fluid to actuate said piston, said linkage means including a rotatably mounted shaft extending in said cylinder and being connected to said follower for rotary movement and a link connected to said shaft externally of said cylinder operatively connected to said servo pilot valve.

2. An actuator as claimed in claim 1 wherein said bore of said piston is contoured substantially conically.

3. A hydraulic system including a servo valve, an actuator including a piston slidably mounted in a cylinder, said piston having a reaction face responsive to fluid in said cylinder and a cam face formed in an interior portion of said piston said servo valve having means for communicating fluid to and from the reaction face of said piston, said system including a linkage system providing input and feedback signals to said servo valve to cause it to control said piston, said linkage system having feedback means including a follower in said cylinder bearing against said cam face, a rotatably mounted shaft having a portion extending into said cylinder and being connected to said follower so as to be rotated thereby as said piston moves rectilinearly and linkage means interconnecting said shaft and said servo valve to reposition it to a null position as a function of the displacement of said piston.

4. A hydraulic system as claimed in claim 3 including a rocker arm having one end operatively connected to said servo valve and the other end providing the input signal to said servo valve and a link attached to said shaft at one end and attached to said rocker arm on its other end intermediate the ends thereof so as to provide the feedback signal to said servo valve.

5. A hydraulic system as claimed in claim 4 wherein said servo valve includes a pilot valve having a spool directing fluid into and out of said cylinder, and a spring urging it in one direction and said linkage means urging it in the opposite direction.

* * * * *